United States Patent [19]

Kinski

[11] 4,274,429

[45] Jun. 23, 1981

[54] UMBRELLA

[76] Inventor: Ernst Kinski, Prinz-Georg-Strasse 94, 4000 Düsseldorf, Fed. Rep. of Germany

[21] Appl. No.: 949,559

[22] Filed: Oct. 10, 1978

Related U.S. Application Data

[62] Division of Ser. No. 823,202, Aug. 9, 1977, Pat. No. 4,144,900.

[30] Foreign Application Priority Data

Aug. 20, 1976 [DE] Fed. Rep. of Germany ..... 2637502
Jun. 28, 1977 [DE] Fed. Rep. of Germany ..... 2729026

[51] Int. Cl.[3] ..... A45B 19/00; A45B 25/14

[52] U.S. Cl. ..... 135/20 A; 135/27; 135/33 R

[58] Field of Search ..... 135/22–27, 135/76, 33 R; D88/4

[56] References Cited

U.S. PATENT DOCUMENTS 3,464,431 9/1969 Loefler ..... 135/20 A

FOREIGN PATENT DOCUMENTS 2001713 9/1969 France .

*Primary Examiner*—Reinaldo P. Machado
*Attorney, Agent, or Firm*—Toren, McGeady and Stanger

[57] ABSTRACT

An umbrella is convertible between an expanded and contracted position to adjust the area of coverage thereof when the umbrella is in the opened condition. The umbrella is formed with a pair of sticks which extend from the handle thereof with the sticks being pivoted at the handle for movement between a spread position whereby the sticks may be placed in a generally V-shaped configuration, and a position wherein the sticks are brought together to be generally parallel with each other. Each stick includes a slider which may move relative to the stick in order to effect opening and closing of the canopy of the umbrella, which canopy is generally supported upon the ends of the sticks by ribs. With the sticks in a generally parallel position, a smaller area of coverage is provided by the umbrella. By spreading the sticks apart into the V-shaped configuration by pivotal motion thereof about the handle, the canopy of the umbrella is spread to cover a larger area and the umbrella may be used, for example, by two persons.

6 Claims, 45 Drawing Figures

23
8
11
21
24
26
5
28
18
6
7
32
30
25
27
32
16d
31
24
12

8
11
21
24
5
28
18
7
30
25a
25b
16d
24
12

11
11
19
29
25

34
35
16
40
37
36

34
37
36
35
16

34'
35
36
35

34
38
39
41
16
40
41
37
36

34'
36

34'
35
36
35
16
34"
42
36"
42
36'

53
52

52
53
54
51

25
50
51
12

25
50
12

433
438
439
440
435
437
436
434
311
380
381
382
15
354
355
360
361
350
351
352
353
362
III
IV
VI 400
421
34
16
17
418
414
411
12

421
404
420
16
401
17

421
16
17
16
418
12

16/17
402
403
401
16
402
421
401
16/17
V
V
401
16/17
403
403
401

402
401'

UMBRELLA

This is a division of application Ser. No. 823,202 filed Aug. 9, 1977, now U.S. Pat. No. 4,144,900.

BACKGROUND OF THE INVENTION

The present invention relates generally to the structure of an umbrella of the type normally used to protect persons against weather conditions. In the general construction of umbrellas of the type to which the present invention relates, a stick or main umbrella shaft has attached at one end thereof a handle which carries at its other end a hub from which ribs of a generally flexible material extend in a radial direction from the axis of the umbrella stick or main shaft. The ribs are circumferentially distributed about the hub of the umbrella and they are pivotally supported thereby at the end of the stick. A slider mechanism which is movable longitudinally on the stick may be operated to open and close the canopy of the umbrella which is attached to the ribs. The slider mechanism has attached thereto stays which are linked between the slider and the ribs whereby the ribs may be moved from a position extending generally parallel to the umbrella stick when the umbrella is closed to a position outstanding radially from the stick to open the umbrella and to extend the canopy thereof.

This type of umbrella design conforms generally to conventional approaches to the manufacture of an umbrella where all of the ribs are of the same length thereby resulting in an umbrella canopy which has a generally circular peripheral configuration. That is, the area which may be covered by such an umbrella when in use generally comprises a circular pattern.

Umbrellas of this conventional type are usually adequate only to protect a single person. When such umbrellas are utilized by two persons together, the available surface of the umbrella canopy is not large enough for a covering sufficient to protect both people so that only a generally insufficient protection from one side of each individual may be produced. When two persons walk side by side it becomes disadvantageous with regard to the protective covering provided by conventional umbrellas even if each person carries a separate umbrella. Even with separate umbrellas, there will be a mutual interference by the lateral overhang of the umbrellas and during a particularly heavy rain water running off from one umbrella will be deflected in the direction of the person walking adjacent to the person carrying the one umbrella.

Attempts have been made to overcome problems arising with regard to covering a plurality of persons walking together during inclement weather. One attempt has involved eliminating the circular peripheral configuration of the umbrella canopy and substituting an elliptical or oblong shaped canopy. Such a structure is known from German Pat. Nos. 29,894 and 447,684. However, in designs of this type, the umbrella ribs must of necessity be made of unequal lengths. In order to facilitate opening and closing of the umbrella without interference with the operation thereof, the longer umbrella ribs must be made longitudinally variable in their lengths and this is accomplished by a design which enables a telescopic type of expansion and contraction of the ribs.

Such a structure, however, not only increases the expense involved in manufacturing the umbrella but it necessarily also involves a rather clumsy folding of the umbrella canopy inasmuch as, because of the unequal lengths of the ribs, the canopy material covering the longer ribs will involve excess material thereby causing a cumbersome folding of the canopy. This not only involves undesired wear of the canopy material but it also produces an unattractive appearance in the folded umbrella. For this reason, it is generally recommended and emphasized that a sheath or covering be used for the folded umbrella, as indicated in German Pat. No. 29,894.

Accordingly, it will be found that with the present state of the art, it would be desirable to provide an umbrella structure wherein the overall area covered by the umbrella may be enlarged without requiring that the ribs of the umbrella be made of unequal lengths and without requiring a telescoping type of umbrella rib.

SUMMARY OF THE INVENTION

The present invention provides an umbrella which is capable of expansion and contraction of the area of coverage thereof by a construction which permits the umbrella canopy to be enlarged or contracted when the umbrella is in an open condition. In the structure of the umbrella, two umbrella sticks or main shafts are provided with both of the shafts being mounted at one end thereof at the umbrella handle. The shafts extend from the umbrella handle and have the canopy and umbrella ribs mounted at the opposite ends thereof. The umbrella shafts may be moved from a generally parallel or closely adjacent position to a spread position wherein the shafts are arranged in a generally V-shaped configuration. With the shafts arranged in their spread-V-shaped position, the canopy of the umbrella is expanded to provide a greater area of coverage. When such a greater coverage area is unnecessary, the umbrella shafts may be brought together into a generally parallel position thereby contracting the overall area covered by the canopy. The canopy which is utilized is a generally continuous canopy which extends over the entire umbrella and which is mounted to both umbrella shafts. When the shafts are brought together, the center portion of the canopy is folded inwardly of the umbrella and a zipper may be provided to maintain the canopy in its contracted position.

Generally, the overall structure of the umbrella includes ribs which are formed in a manner similar to that of conventional umbrellas with the canopy being mounted on the ribs and with a slider mechanism being provided on each shaft to enable opening and closing of the canopy by expansion and collapse of the ribs.

Because of the V-shaped spread configuration of the umbrella sticks, it becomes possible to spread out the areas of the umbrella canopy and to stretch the peripheral outline of the surface of the canopy. The invention is arranged such that both of the umbrella sticks may be provided to carry ribs of equal length. In a general sense, the umbrella of the present invention may be viewed as an arrangement whereby a pair of half umbrellas of conventionally commercial design may be interconnected by an intermediate canopy portion having a width matching the spreading or spacing of the shaft hubs which are located at the upper ends of the umbrella shafts and which extend through the canopy for mounting the canopy to the shafts. The use of two umbrella rib patterns which may be spaced apart and brought together replaces the arrangement whereby elongation of individual ribs is usually required.

In the invention, there is provided a bearing piece whereby the two umbrella sticks may be mounted upon the handle. The bearing piece is generally in a fixed position relative to the handle and provides a slotted recess within which the sticks are supported as they move from the spread to the adjacent position. The width of the recess matches the diameter of the stick ends and the recess is formed to generally lie within a plane within which the sticks move as they are placed between the spread and the adjacent positions.

As a result of the particular configuration of the bearing piece, the sticks may be provided with a particularly stable mounting upon the handle due to the fact that they may be placed and held in a fixed position not only by virture of the lateral surfaces of the recess but also in the spread direction toward the limit stops of the recess.

To facilitate opening of the umbrella, a spring may be arranged within the bearing piece with the spring biasing the umbrella sticks toward the spread position. The spring may operate to initiate extension of the sticks to the spread position.

In a first embodiment of the invention, the sticks may be made in a straight linear configuration throughout with a rigid stick configuration being provided between the handle end of the sticks and the outer points thereof.

An alternative arrangement of the invention involves a construction wherein the sticks are hinged or pivoted along their lengths at generally identical points by swivel bearings with a guide member being provided to maintain the stick parts located remote from the handle in a specified mutual position.

With such an embodiment, greater flexibility exists with regard to shaping the canopy of the umbrella inasmuch as the ends of the sticks extending through the canopy may penetrate the canopy in a direction generally perpendicular to the surface thereof rather than at a slanted angle as is necessary with the V-shaped stick configuration.

In this arrangement, the upper parts of the sticks may be moved parallel to each other by a parallelagram suspension gear system which is provided.

In a preferred embodiment, the sticks may be spread by means of a gear arrangement engageable at an area away from the handle. With respect to this feature, again various embodiments are feasible.

In a first embodiment of such a gear mechanism the gear is comprised of pairs of matching umbrella ribs extending from both sticks which are appropriately interconnected at their ends by means of a link.

Practically, there are provided a pair of adjacently arranged standard umbrellas which are cut off at their interfacing areas and which are placed together with their edges. Where matching ribs for both umbrellas meet they are connected by a link. Upon erecting the ribs they push both of the sticks apart from each other. For this purpose there is no separate gear required for maintaining the sticks spread apart.

Another embodiment of such a gear arrangement involves a device wherein a separate type of gear which is independently actuated from a slider-actuated mounting is provided.

In this case, the umbrella is opened by placing the sticks in a spread out position and then manipulating both sliders to the opened position of the umbrella.

Such a gear is provided by an auxiliary rod attached to the handle in the center between the sticks upon which rod a slider is arranged adjustably from the handle to an arrested position upon which a pair of auxiliary stays are linked at one end and which at the other ends are linked to the rod hubs of both sticks.

Movement of the slider causes the sticks to be spread apart by means of auxiliary braces.

The slider may consist of two parts which are mutually movable in the longitudinal direction of the auxiliary rod, one of which is adapted to be held and the other of which is engaged by auxiliary stays, with a spring being provided between both parts which spreads the sticks under a spring load in the held position of the slider. The spring acts with a flexible pressure upon the sticks and in this manner on part of the canopy stretched between them whereby the surface size of the canopy need not become either overstretched nor unduly slacked.

In an embodiment without an auxiliary rod, a spreading gear may be provided near the spoke hubs between the sticks to engage the latter to snap in at a position matching the spread position of the sticks and to collapse between the sticks for folding the umbrella.

The spreading gear in the spread position of the sticks produces a cross-stay holding the sticks in their spread position.

Specifically, the spreading gear may consist of cross rods having their ends linked with the umbrella sticks which are interconnected by a link in the center between the sticks toward the handle and which may be placed from a buckled position through a straight aligned position to a buckled position by a narrow angle into the other direction, where any further buckling is prevented by a limit stop.

This may be implemented so that a linkage is provided at a center piece carrying a gripper nose upon which a limit stop is placed for the cross rods.

The center piece simultaneously serves to actuate the spreading gear and its fixing in the extreme position.

In a special embodiment, the center piece may cover two oppositely positioned shells pressed together under a spring load which are equipped on the outside with recesses for receiving the ends of cross rods in their extreme position.

The cross rods extend on the outer side over the shells. Upon reaching the extreme position the shells snap apart and the cross rods are received by the recesses. The latter are adapted to the shape of the cross rods and prevent their usual swiveling. In this manner the spreading gear is arrested in both directions. Release for folding the umbrella is effected by compressing the shells which consequently again release the cross rods.

It is also feasible to utilize cross rods which cover the sticks with forked ends, with these ends pivotally supported on the sticks by cross pins and in the extreme position laid with a forked base against the sticks.

Here again, springs may be provided which are loaded to push the spreading gear toward the extreme position in order to facilitate opening of the umbrella.

An important development of the invention consists in providing a coupling by means of which the sticks may be adjacently fixed in their parallel position. Such an arrangement not only facilitates the handling of the folded umbrella but is also of significance with relation to a further feature according to which a zipper may be provided whereby when the umbrella sticks are moved to their closed or parallel position the canopy of the umbrella may be zipped so as to be held in its contracted position.

Umbrellas provided with features such as those of the present invention may be used in a manner generally similar to the usual manner of utilizing an umbrella with an approximately circular outer periphery for the canopy of the umbrella when the umbrella is to cover one person. Selectively, the umbrella coverage area may be enlarged when two persons are to utilize the umbrella. For use by one person, the sticks are placed in a generally parallel position coupled together and, if a zipper is provided, the zipper may be closed and the umbrella may be opened and closed by actuating both sliders, one each on each stick. Such a structure may of course involve an arrangement whereby the sliders may be actuated with coupled sticks. For use by two persons, the sticks may be decoupled, the zipper released and stretching of the canopy being accomplished after spreading apart of the sticks.

A useful development of the invention involves an arrangement whereby a screen of transparent material may be provided to run from a lower edge area of the canopy about parallel to the spreading plane of the handle. This screen may serve as a wind screen for wind and rain protection with the screen generally operating as a windshield.

Because the umbrella of the present invention by comparison with commercial embodiments is of a larger size, it is recommended that a support surface for the thumb of the hand gripping the umbrella be provided on the handle in order to effect an especially safe and forceful handgrip.

It is also recommended that spacer parts be provided on the sticks which engage with parallel compressed sticks by way of projections and recesses to produce for the arrangement of both sticks a rigid unit in cases where an umbrella with parallel sticks is used as a standard umbrella with circular perimeter.

An important feature of the invention which may also be applied to standard umbrellas with only a single stick is that tension springs may be provided engaged between umbrella ribs and stays with an applicable spacing from the stay linkage point to the ribs with the springs being arranged on the side of the angle narrowing between the ribs because of the swiveling of the stays against the ribs when placing the umbrella in the open position.

The tension of the springs may be arranged so that the mounting arrangement is such that a particularly simple and automatic mounting action is created.

For reasons of efficiency holder pieces may be provided on the ribs and/or stays at which the tension springs engage. The holder pieces may be developed as sheet metal parts enclosing the ribs and/or stays.

The tension springs may be developed as helical springs, preferably made of corrosion proof steel. Specifically, the holder pieces may be equipped with a tongue in which holder lugs at the end of the spiral springs may be hooked.

In a preferred embodiment of the invention where each stick carries seven ribs, which are arranged with reference to the sticks in a circumferential direction at identical spacings and of which five are of the same length, the remaining two being shortened and opposed to each other at the center between the two sticks and being interconnected at the ends by links.

With this embodiment only two links are required at the shortened ribs. Because of the division by seven, one of the longer ribs in the plane of the sticks is turned outside so that the ground projection of the umbrella canopy is pointed in the width direction and projects particularly far out. In the center, the ribs adjacent to the shortened ribs do not meet which, as will be described hereinafter, provides for the possibility that the shape of the umbrella may be effected in a simple manner by a suitable sectional cut of the covering.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 1:
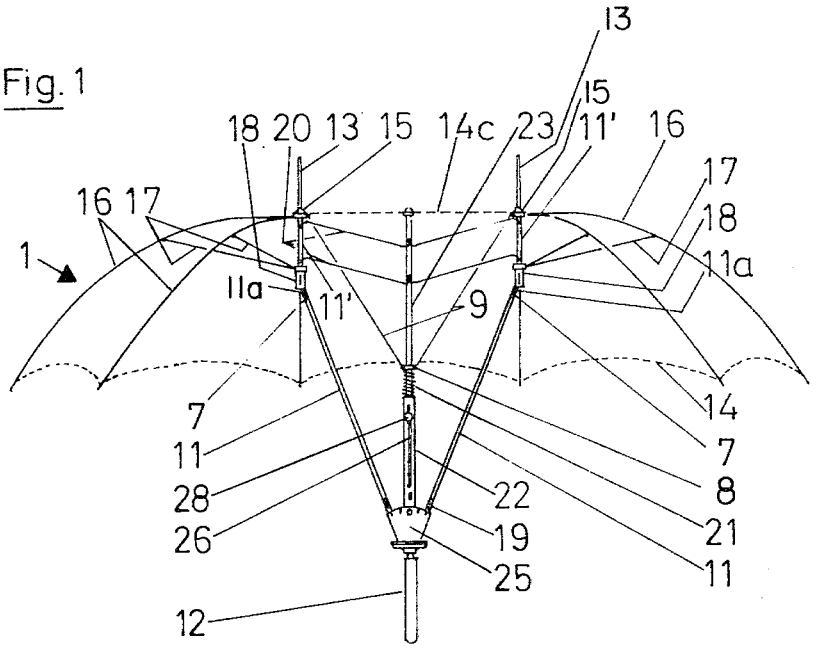
FIG. 1 is a side elevation of a first embodiment of the invention showing the umbrella in the opened position arranged in its fully stretched out condition to provide expanded coverage.
Figure 2:
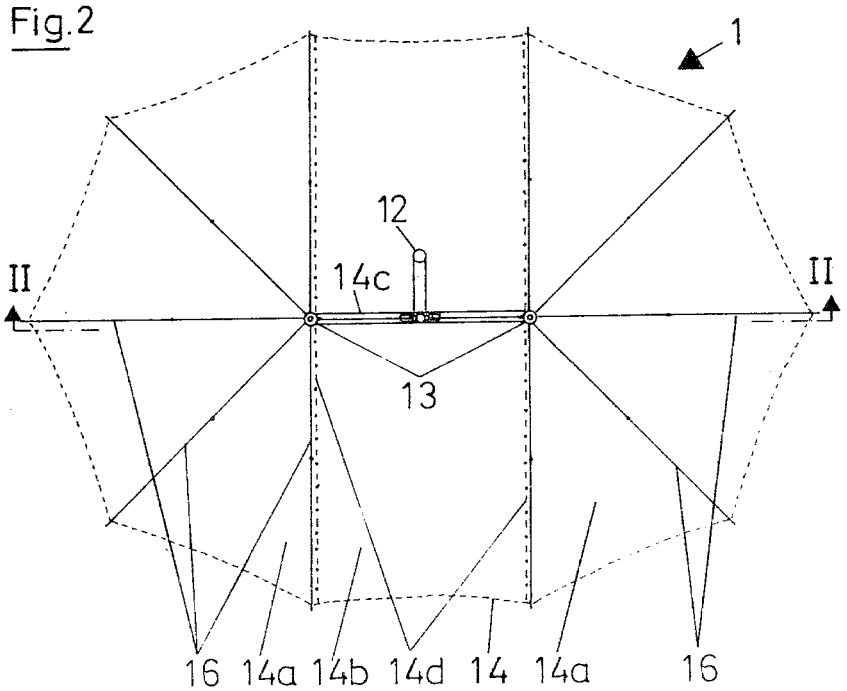
FIG. 2 is a top view of the umbrella shown in FIG. 1.

Referring now to the drawings, wherein like reference numerals refer to similar parts throughout the various figures thereof, a first embodiment of the invention is depicted in its expanded and contracted condition in FIGS. 1–4. In FIGS. 1 and 2, the umbrella is shown with its canopy in the expanded condition and in FIGS. 3 and 4 the contracted condition is depicted. With reference to this embodiment, the umbrella of the invention is formed to include a bearing piece 25 which is fixedly connected to a handle 12 having a generally conventional configuration. The bearing piece 25 is equipped with a slotted recess within which a pair of umbrella sticks or main shafts 11 are engaged to extend therefrom, with the sticks being arranged to enable a swiveled or pivotal motion thereof within the slotted recess of the bearing 25. The sticks may be swiveled within the bearing 25 from a V-shaped spread position shown in FIG. 1 to a parallel or closed position depicted in FIG. 3.

At a point intermediate the sticks 11 and generally located midway therebetween there is provided an auxiliary rod 22 which is fixedly connected with the bearing piece 25 and which contains a slider tube 23 which is arranged to be slidably moved within a slot 26 by means of a knob or projection 28.

Each of the sticks 11 are formed at their upper ends with a link member 11a which pivotally connects the lower portions of the sticks 11 with upper stick portions 11', the upper stick portions 11' being engaged at their upper end with stick points 13. Thus, the overall shaft length of the main umbrella shaft is composed of the sticks 11 which are swivelly or pivotably connected by means of the link members 11a to upper portions of the sticks which include the upper portions 11' and the stick points 13. The upper portions 11' and the stick points 13 may, by way of example, extend over about one third of the entire length of the overall umbrella stick or shaft.

Located between the stick points 13 and the upper stick portions 11' are stick hubs 15 which have pivotably or swivelly connected thereto the umbrella ribs 16 which are supported to extend radially from the hubs 15.

In the embodiment depicted in FIGS. 1–4, the ribs 16, which are connected to the hubs 15 and which extend therefrom generally outwardly of the umbrella, are formed of equal lengths and are generally equally spaced apart in the radial direction around the hub 15. An example of an appropriate radial spacing of the rib 16 would be about 45°. In the embodiment depicted five ribs 16 are shown as radiating outwardly from the hub 15 away from the center of the umbrella. As best seen in FIG. 2, no ribs 16 are provided on the sides of the hubs 15 which face the adjacent hub 15. Thus, in the embodiment of FIGS. 1–4, there are provided two generally semi-circularly shaped umbrella surfaces which are represented by the reference numeral **14*a*. Each of the segments 14*a* are arranged with a spacing therebetween such that the segments 14*a* are separated from each other by a generally rectangular umbrella surface indicated as 14*b*. The entire canopy or covering for the umbrella is designated as 14 and the outline of the overall canopy 14 is indicated by the dashed lines shown in FIGS. 1–4**.

Arranged on the sticks 11 are sliders 18 which have swivelly connected thereto stays 17 which are engaged between the sliders 13 and the ribs 16. The stays 17 are located to extend in a plane passing through the axes of the sticks 11 and/or the stick points 13 with the opposite ends of the stays 17 engaging the ribs 16 generally centrally thereof. The sliders 18 may be actuated in a direction toward the stick points 13 to open the umbrella by causing movement of the ribs 16 in the usual manner. Thus, when the sliders 18 are moved upwardly toward the sticks 13, the ribs 16 will be brought into their extended position and the canopy 14 will be tautly held with the umbrella in the open position. The sliders 18 are fixed in their upper positions by a projecting retention device.

Provided in the umbrella of FIGS. 1–4 is a tension spring 21 which covers a slider tube 23 and which is stayed against the auxiliary rod 22. The spring 21 acts against the slider 8 which is movably arranged on the slider tube 23. Linked to the slider 8 are auxiliary supports 9 which engage the stick hubs 15 and which are loaded by the tension spring 21 to cause spreading of the sticks 11 into a V-shaped configuration as soon as the sticks become slightly spread apart. In this way, the process of putting up or opening the umbrella is enhanced and facilitated.

In order that the stick points 13 retain a specified mutual relative position, and in the embodiment of FIGS. 1–4 this relative position would be of a generally parallel nature, a spreading gear is provided. The spreading gear consists of cross rods forming a parallogram arrangement, with the rods being spaced from each other in the direction of a slider tube 23 and being swivelled to the stick points 13 and also to the slider tube 23 in the spreading plane.

The limit position of spreading the sticks 11 and, thus, for spacing apart the stick points 13 is determined by a band **14*c* which extends at the level of the covering or canopy 14 and which interconnects the stick points 13**.

As best seen in FIG. 2, the umbrella of the embodiment depicted is provided with a zipper **14*d* which extends across the entire width of the canopy 14 and is attached at the upper side of the canopy 14 at the level of the stick points 13. As best seen in FIG. 2, when the zipper 14*d* is in its opened condition, one half of the zipper will lie on one side of the band 14*c* and the other side of the zipper will lie on the opposite side of the band 14*c*. The purpose of the zipper 14*d* is to support and hold the umbrella in the closed or contracted position shown in FIGS. 3, 4. That is, with the sticks 11** being brought into a parallel position while the umbrella canopy is in its opened condition, the zipper 14d may be zipped shut to hold the umbrella in the condition shown in FIGS. 3, 4. Thus, if it is desired that the umbrella 1 be used in the form of a standard umbrella capable of covering a single person in a manner already known to those skilled in the art, then the sticks 11 may be placed in the parallel position best seen in FIG. 3, and they are rigidly held together by a coupling 33 which is placed in engagement between the stick points 13. With the sticks 11 brought into the position shown in FIG. 3, the zipper 14d may be closed whereby the material forming the rectangular canopy surface 14b (FIG. 2) hangs down in a loop between the sticks 11. The umbrella 1 may then be opened by means of sliding both the sliders 18 up to their snap-in positions. In this manner, the canopy 14 is brought into a shape, as seen in FIGS. 3 and 4, by means of stays 17 and ribs 16 whereby both nearly semi-circular umbrella surfaces 14a are moved together and a generally circular perimeter for the umbrella surface is produced which is depicted best in FIG. 4.

Figure 3:
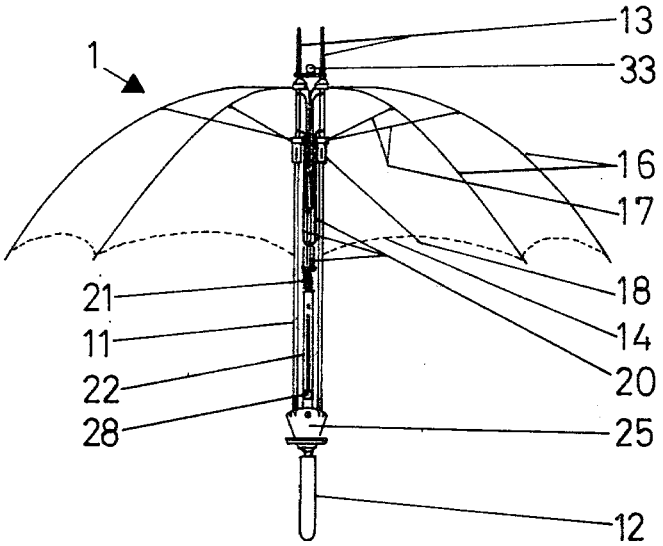
FIG. 3 is a side elevation of the umbrella of FIG. 1 shown in its opened position with the coverage of the umbrella being contracted.
Figure 4:
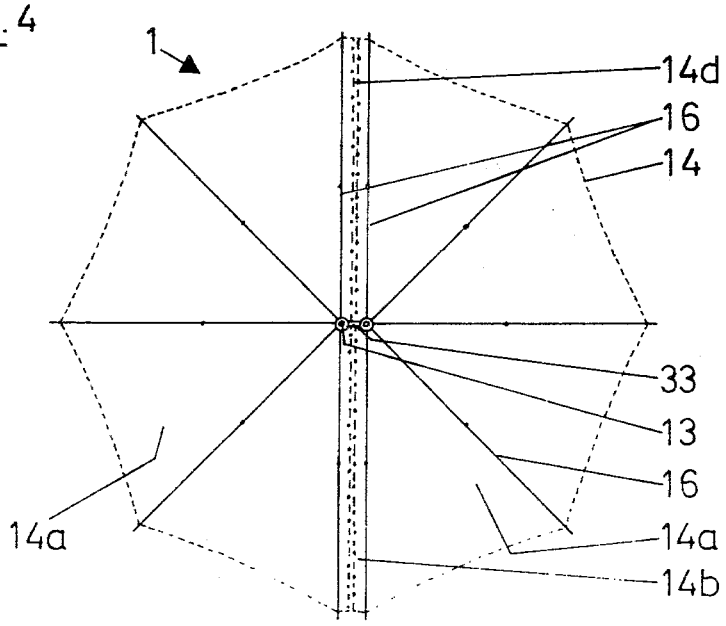
FIG. 4 is a top view of the umbrella shown in FIG. 3.

Of course, when an umbrella having an expanded covering as best seen in FIG. 2 is desired, then the zipper 14d may be opened and the sticks 11 brought into their V-shaped position shown in FIG. 1 with a greater covering of the canopy being provided than that which may be provided when the umbrella is in the condition depicted in FIGS. 3, 4.

Figures 33, 34, 35, 36:
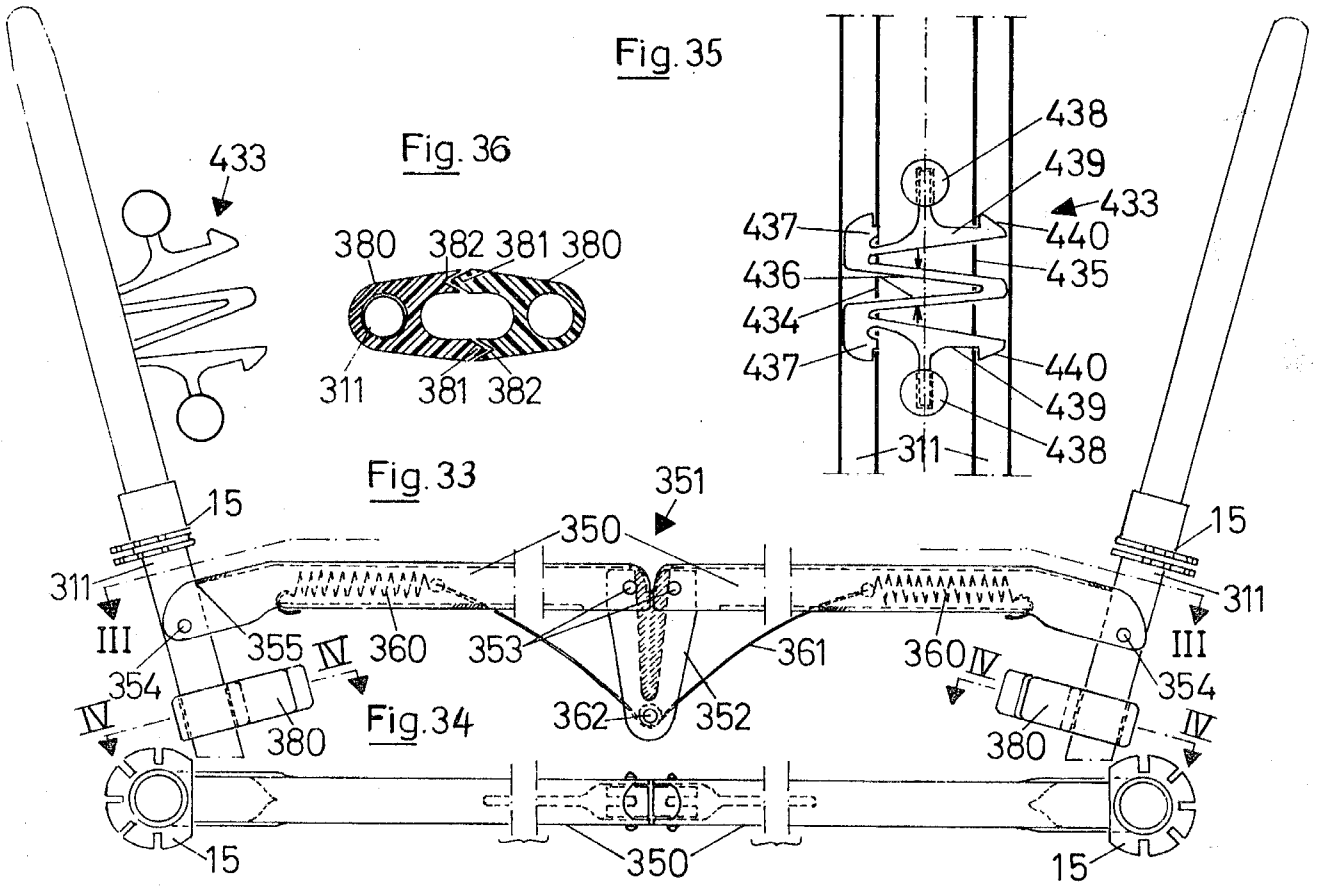
FIG. 33 is a side view of another embodiment of a spreading gear in accordance with the present invention.
FIG. 34 is a top view of the spreading gear shown in FIG. 33 taken along the line III—III.
FIG. 35 is a detailed view showing an embodiment of a coupling device for both the sticks of the umbrella of the present invention.
FIG. 36 is a sectional view taken along the line IV—IV of FIG. 33, showing this portion of the spreading gear with the sticks in the adjacent or closed position.

The coupling 33 which is utilized in the embodiment of FIGS. 1-4 generally involves a linkage having two perforations for the stick points 13 to be engaged therein. Another embodiment of this type of coupling is shown in FIG. 35 and will be described in greater detail hereinafter.

Figure 5:
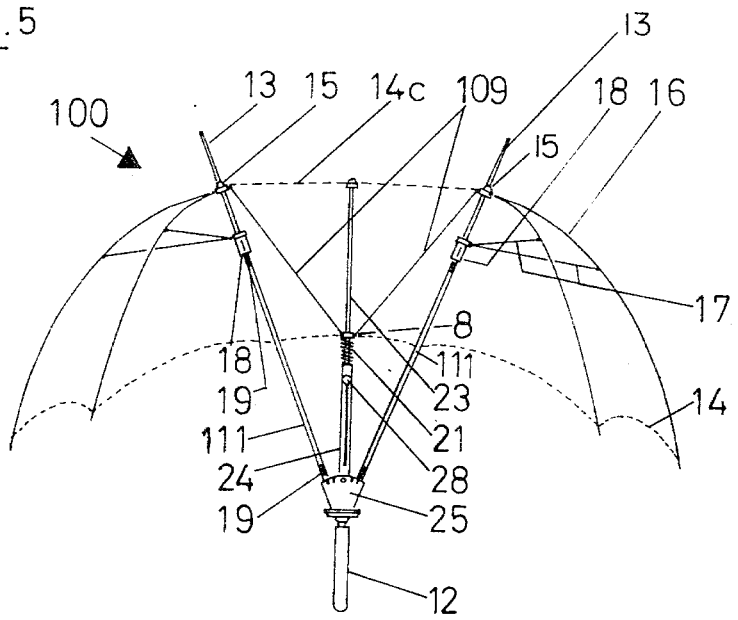
FIGS. 5 and 6 are, respectively, a side elevation and a top view of an umbrella comprising a further embodiment of the invention.
Figure 6:
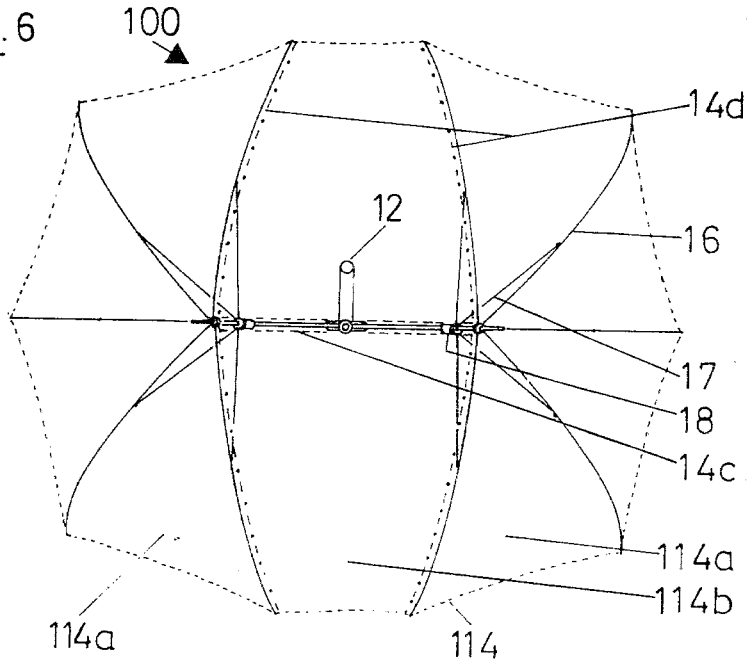

Another embodiment of the present invention is shown in FIGS. 5 and 6. An umbrella 100 which differs from the umbrella 1 of FIGS. 1-4 involves umbrella sticks or main shafts 111 which are formed to extend in a straight rigid configuration throughout their lengths without utilization of a link 11a as shown in the embodiment of FIGS. 1-4. As a result, in the embodiment of FIGS. 5, 6, the umbrella 100 does not require a parallogram gear 20 such as that required for parallel guidance of the upper parts of the umbrella sticks in the embodiment of FIGS. 1-4. The spreading of the sticks is accomplished solely by means of auxiliary stays 109 under the influence of springs 21 which are loaded by sliding of the knob or projection 28 to its snap-in position. The opening or putting-up of the umbrella 100 is accomplished in the conventional manner by sliding up the sliders 18 to their notched position.

Additionally, with umbrella 100, a standard umbrella configuration may be effected by collapsing the sticks 111. This collapsed configuration would be alternative to the arrangement shown in FIG. 6 where the umbrella canopy is in its expanded open position. A zipper 14d is provided and upon collapsing of the sticks 111, they may be blocked by closing the zipper 14d whereby umbrella surface 114b will be folded into a single fold and both of the umbrella surfaces 114a move together to a contiguous location whereby a generally circular umbrella canopy perimeter may be provided.

Figures 7, 8, 9:
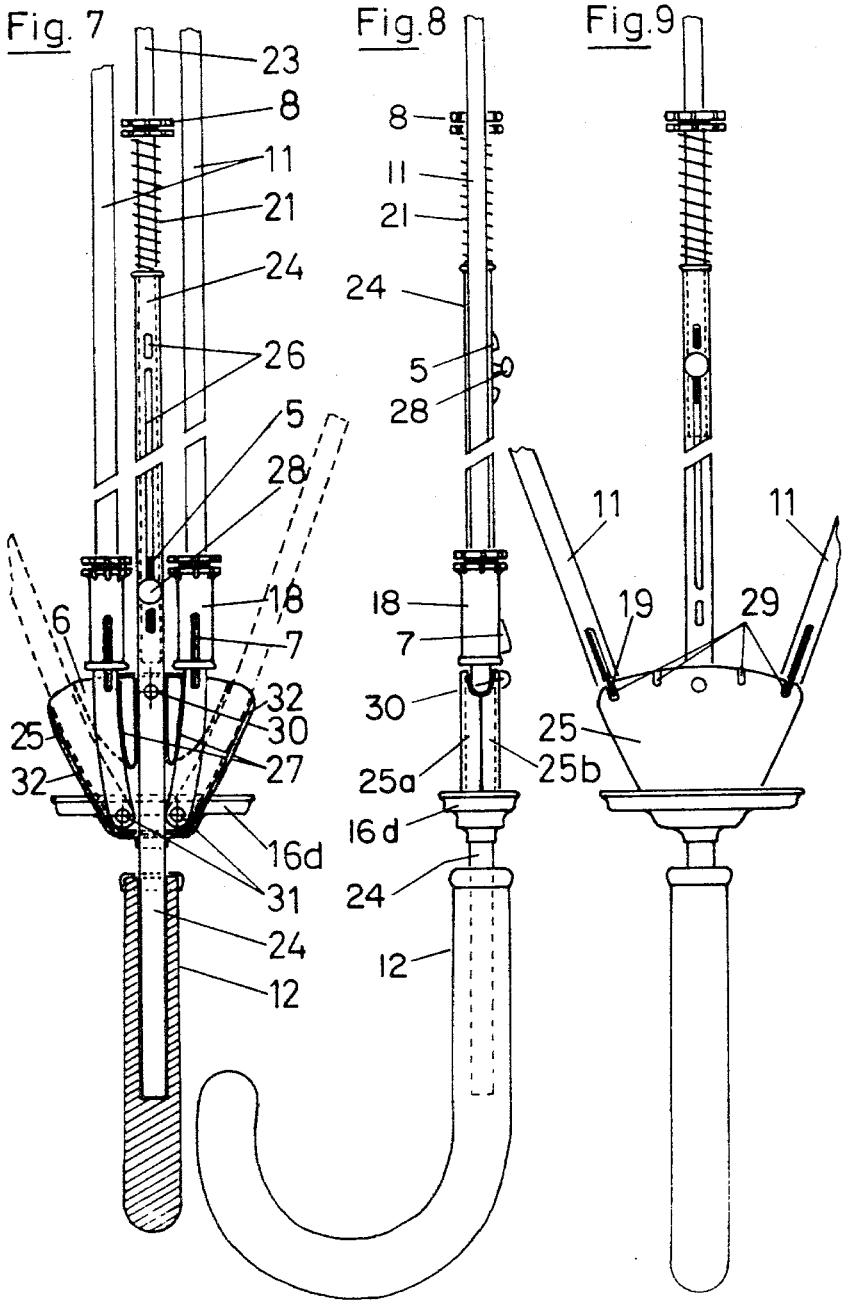
FIG. 7 is a view partially in section showing the handle portion of the umbrella of the invention.
FIG. 8 is a side view of the portion shown in FIG. 7 taken from the left side thereof.
FIG. 9 is a partial elevational view showing the umbrella sticks in a spread position.

In FIGS. 7 through 9 there are shown the details of the assembly of a bearing piece 25. The bearing piece 25 consists of a pair of V-shaped sheet metal shells 25a and 25b flanged at the V-sides, as best seen in FIG. 8, which with their open sides facing one another are interconnected by a rivet 30 in order to form a slotted recess 6 which opens upwardly toward the open side of the "V".

Rivet 30 simultaneously operates to retain auxiliary rod 24 which extends beyond the bisecting line of the V-angle through the recess of the bearing piece 25 and at its lower end operates to carry the handle 12 of the umbrella.

Sticks 11 arranged on both sides of the auxiliary rod 24 engage at their lower ends within the recess 6 and they are at the base of the recess 6 swivelled to be supported by cross rivets 31 in the spreading plane which is also the plane within which the slotted recess 6 is located. The sticks 11 may be swivelled to their fully spread position which is indicated in FIG. 7 in dotted line form and in this position the ends of the sticks 11 are arranged with their outer sides in abutment with the V-shaped flange which is produced within the bearing piece 25 to provide limit stops 32 for the sticks. Because the recess 6 is of a width which is adapted to the diameter of the sticks 11 and/or the auxiliary rod 24, these elements are balanced in the spread position in the bearing piece 25.

When the umbrella is to be opened or put up, the spreading of sticks 11 is supported by springs 27 which are arranged between the auxiliary rod 24 and the ends of the sticks 11 and which are loaded to push them apart.

The sticks 11 are equipped with clips 19 by means of when they may be additionally stopped or engaged in the spread position in the bearing piece 25 by engagement of the clips 19 in cooperating notches or recesses 29. The sliding knob or projection 28 for the slider tube 23 is also equipped with clips or detents 5 by means of which knob 28 and/or the slider tube 23 may be rigidly held in the auxiliary rod 24 in the low position corresponding with the position of the fold or closed umbrella best shown in FIG. 7. Furthermore, the knob may be held in the upper or umbrella-open position shown in FIG. 8.

The auxiliary stays 9 and/or stays 20 engaging at sliders 8 and 18 are not shown in FIGS. 7-9 in order to provide a clearer view of the elements depicted therein.

Bearing piece 25 is also connected with a dishshaped rib engaging member 16d which receives the ends of the ribs when the umbrella is in its closed or folded position and which operates to tend to hold together the ribs of the folded umbrella.

The bearing piece shown and described in FIGS. 7-9 may also be suitably used in connection with the umbrella 100 depicted in FIGS. 5 and 6.

A further embodiment of the present invention in the form of an umbrella 200 is depicted in FIGS. 10-21.

In this embodiment, the spreading of sticks 211, which are of the type extending in a straight linear configuration throughout their lengths, is accomplished not by a special spreading gear but by the umbrella ribs themselves. Each of the sticks 211 is provided with a set of ribs which include ribs 16, 16' and 16'' which are set apart radially at an angle of about 45° with two adjacent ribs 16'' being shorter than the remaining six equally long ribs 16 and/or 16'. The arrangement of the ribs for both of the sticks 211 face each other with the sides upon which the shorter ribs 16'' are located.

The matched pairs of shorter ribs 16'' on both of the sticks 211 are interconnected by links 34, as are the matched pairs of adjacent longer ribs 16'. This results in the formation of a wedge shaped umbrella surface 214b located between the sticks 211. By comparison with a conventionally generally circular umbrella pattern, the surface of umbrella 200 is enlarged by the addition of two 45° sectors between two standard length ribs 16', a wedge shaped umbrella surface **214*b* and both umbrella surfaces 214*e* (FIGS. 10 and 11) extending between the points of the ribs 16' and adjacent ribs 16**.

Both of the sticks 211 of the umbrella 200 are provided with an automatic umbrella erecting device which covers a slider 218 slidably set upon each of the sticks 211 against the leading edge of which a tension spring 211 is applied. The spring acts against a slider part **218*a* on the side remote from the slider 218 which is movably arranged on the stick 211. On the sliders 218, 218*a* there are connected stays 217 which are linked at a common linkage point and are attached to individual ribs 16, 16', 16''. The stays 217 form a triangle, with the spring 221 lying along one side of the triangle. Upon shifting along the stick 211, the length of this side of the triangle is changed to the extent that, beginning from the closed position the slider 218 is released from its lock 19 at the lower end of the stick 211, and the spring 211 is loaded to produce an effect such that the slider 218 moves away from the handle 12 and simultaneously the ribs 16, 16' and 16'' are extended outwardly by means of the stays 217. In order to open the umbrella 200 it then is only necessary to actuate the locks on both the sliders 218. The umbrella 200 will unfold automatically in a manner depicted in FIGS. 10 and 11**.

Figure 10:
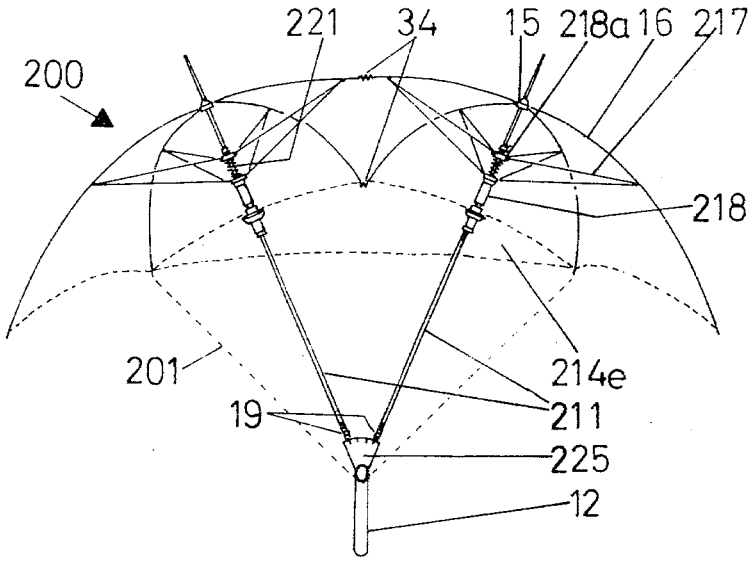
FIGS. 10 and 11 are, respectively, an elevational view and a top view showing a further embodiment of the invention.

As shown in FIG. 10, the umbrella is provided with a screen 201 which is depicted in dashed lines to extend from the lower edge of the umbrella canopy from the sectors thereof adjacent the ribs 16' to an attachment point at the handle 12. The screen 201 may consist of a transparent material and may serve to provide further protection from rain and wind coming from a frontal direction.

Figure 12:
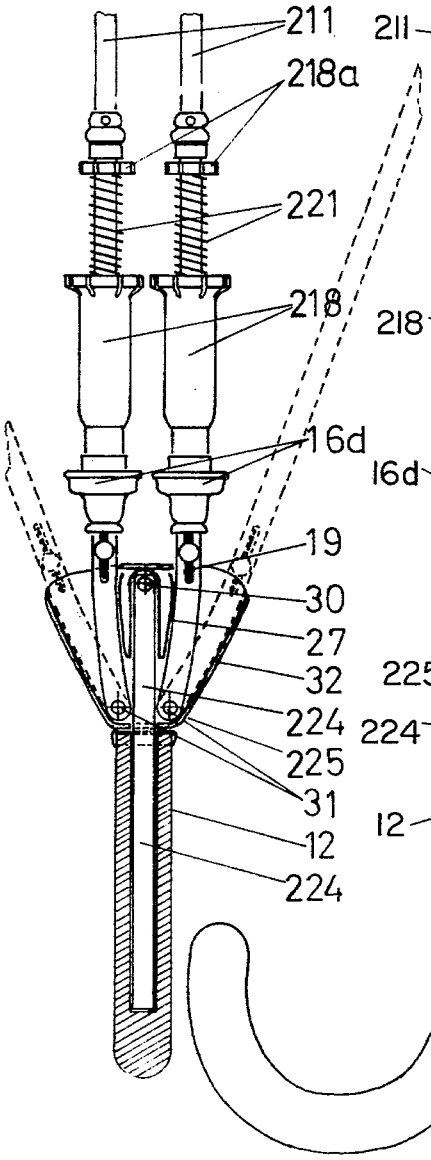
FIGS. 12, 13 and 14 are views similar to the views of FIGS. 7, 8 and 9 showing features of the invention.
Figure 13:
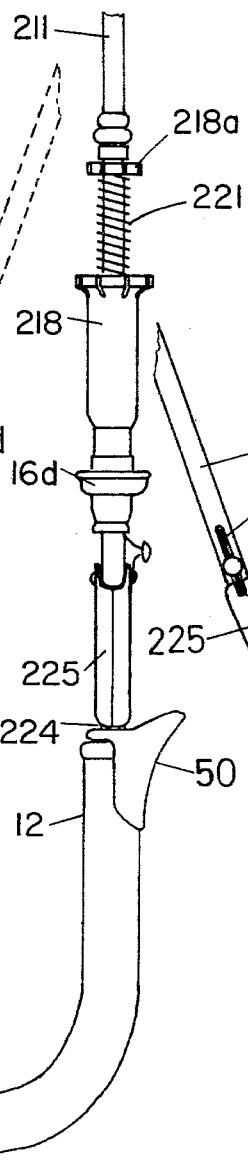
Figure 14:
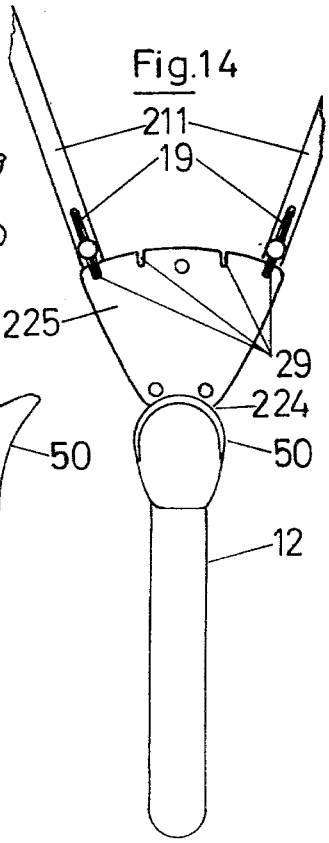

In FIGS. 12–14 there is shown a bearing piece 225 which is basically similar to the bearing piece 25 with the exception that no auxiliary rod 24 penetrating into the handle 12 is provided. Instead, only a short connector rod 224 is included which terminates within the bearing piece 225 and is retained at its end by rivet 30 holding together the shells of the bearing piece 225.

Figure 11:
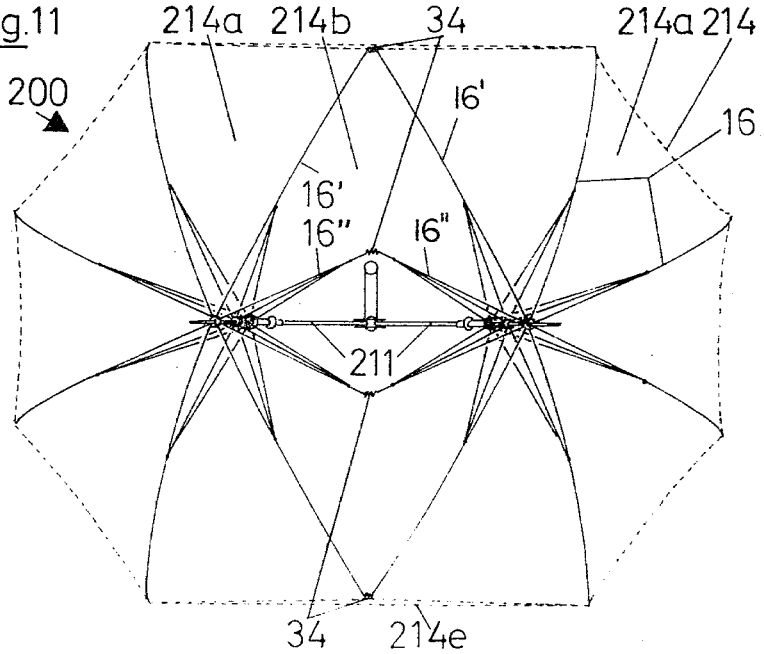
Figures 15, 16, 17, 18, 19, 20, 21, 22, 23, 24, 25:
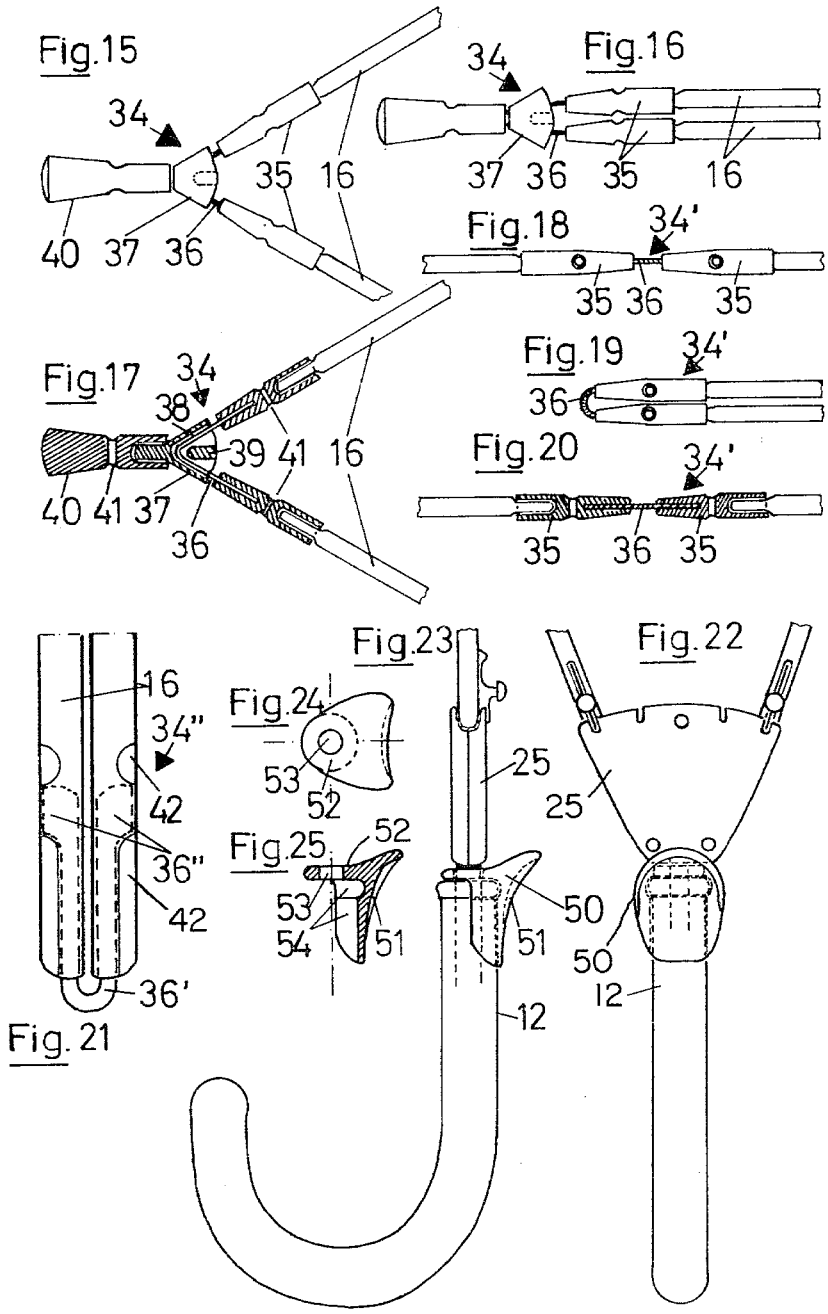
FIGS. 15, 16 and 17 are partial detailed views showing a first arrangement of a link for connecting the ribs of an umbrella according to the invention.
FIGS. 18, 19 and 20 are sectional views showing a further embodiment of a link for interconnecting the ribs.
FIG. 21 is a view of a third embodiment of a connecting link.
FIGS. 22 through 25 are detailed views showing a molded piece for application to the umbrella handle developed as a thumb grip.
Figure 26:
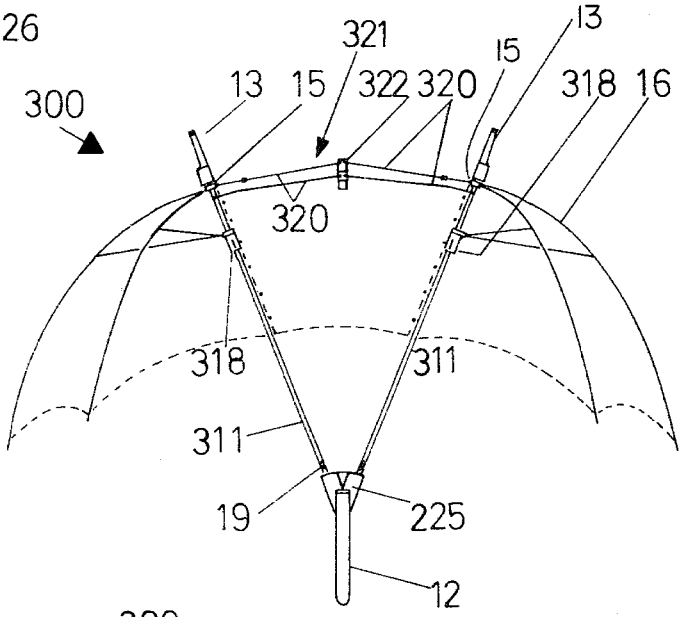
FIGS. 26 and 27 are, respectively, a side elevation and a top view of a fourth embodiment of the invention showing the umbrella canopy in its extended condition.
Figure 27:
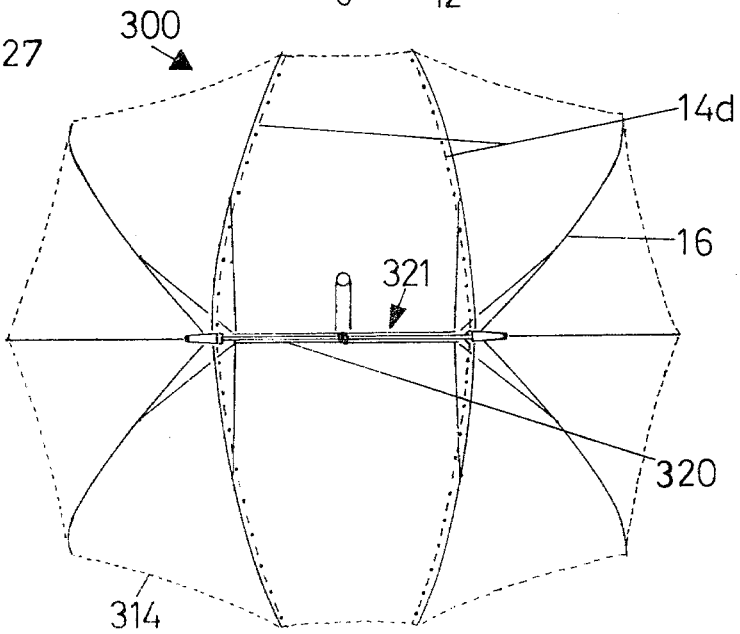

Shown in FIGS. 15–17 is an embodiment of the link 34 utilized in the umbrella of FIGS. 10, 11, by means of which matched ribs 16 may be swivelled together. The link 34 includes nipples 35 formed in the shape of elongated pods which with one end are pressed on to the ends of ribs 16 to be connected thereto and which have their other end connected with a flexible wire 36 upon which the nipples are pressed, the wire 36 interconnecting two nipples 35 at a specified spacing. The free part of the flexible wire 36 between the nipples 35 is guided through guide part 37 which is equipped with a V-shaped recess 38 into which flexible wire 36 engages in a looped formation. Centered between the sides of the "V" is a stem 39 about which the wire loop is slung and which prevents the loop from being pulled out of the recess 38. The ribs 16 connected in this manner may be swivelled out of the parallel position shown in FIG. 16 into the spread position shown in FIG. 15 without producing an intolerably severe break in the flexible wire 36. Guide part 37 carries a button 40 on the side thereof away from the rib 16 which enables attachment of the canopy 214 while providing some protection and improved appearance whereby the canopy is sewn into button 40 and nipples 35 by cross holes 41.

In FIGS. 18–20 there is shown a link 34' which represents a simpler design and which differs from the length 34 only to the extent that the guide part 37 and the button 40 are omitted.

In FIG. 21, a link 34'' is shown wherein a cord of a cable-like connector part 36' is placed into the ends of a U-profiled type of rib 16 with its thickened ends 36'', it being so retained that the free sides of the ribs 16 forming the U profile are pressed together on both sides of heat 36' at point 42. The connector piece 36' may consist, for example, of a flexible synthetic material.

In FIGS. 22–25 there is shown a gripper piece 50 which may be used with all of the umbrella embodiments of the present invention and which is formed in the shape indicated in the drawings. The piece 50 encompasses an auxiliary rod 24 and/or rod 224 in a bore 53 of attachment piece 52 in the shape of a perforated plate between handle 12 and bearing piece 25. Gripper piece 50 is applied to the upper part of the handle 12 with its inner surface 54 and it is attached there in a manner to prevent its rotation. On the side thereof turned toward the thumb of the hand of a user, the grip part is shaped to provide an appropriate surface 51 whereby safe and comfortable handling of the umbrella is facilitated.

Referring now to FIGS. 26–35 there is shown therein a further embodiment of the invention comprising an umbrella 300 wherein no auxiliary rod is utilized and wherein both of the umbrella sticks 311 are developed throughout their length to be straight and generally rigid. The sticks are supported in a bearing part 225 which is generally similar to the version thereof utilized in the embodiment shown in FIGS. 10–14. Each stick 311 carries five ribs 16 set from each other by an angle of about 45°. The sides of the rib arrangements on both sticks 311 are characterized by the elimination of several ribs which would otherwise be required if a distribution of ribs all about the sticks was to be provided. The perimeter of the canopy of the umbrella generally coincides with that of FIG. 6. With this embodiment, as will be seen from FIGS. 28 and 29, the umbrella may be formed in accordance with FIG. 29 with a standard conventional generally circular canopy perimeter by bringing the sticks 311 into a parallel position and by providing a coupling therefor by closing a divisable zipper lock **14*d* shown in its open condition in FIG. 27** when the enlarged canopy of the umbrella is to be utilized.

Figure 28:
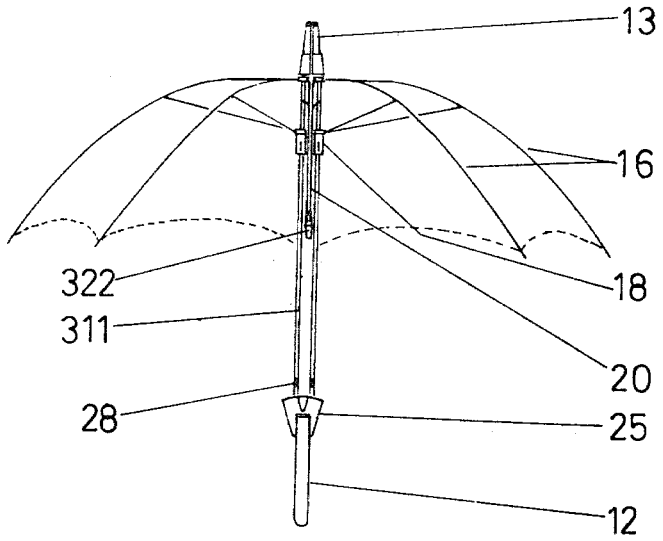
FIGS. 28 and 29 are, respectively, a side elevation and a top view showing the embodiment of FIGS. 26 and 27 with the canopy in its contracted position.
Figure 29:
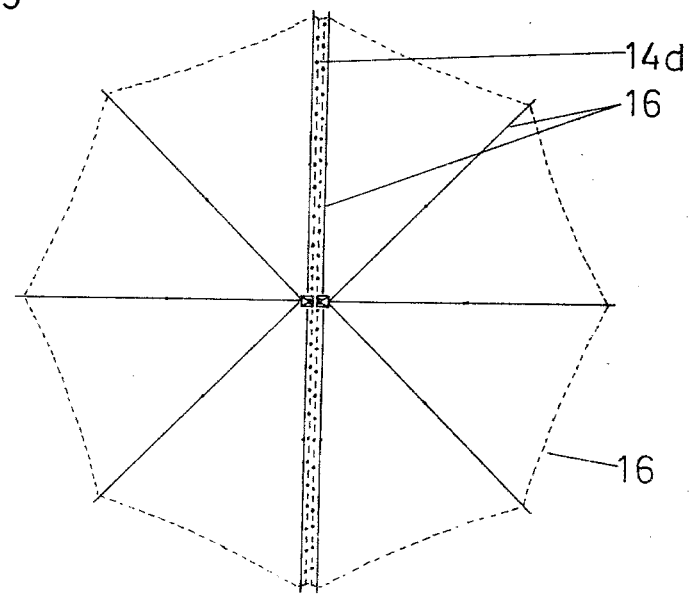

In FIGS. 26–31 a spreading gear designated as 321 is provided for enabling spreading apart of the sticks 311. Cross rods 320 in the proximity of the stick hubs 15 engage at the upper area of the sticks 311 and extend approximately parallel to each other to the center between the sticks 311 where they are swivelled on a center piece 322 in the spreading plane. In order to close the umbrella, the centerpiece 322 is pulled downwardly from the position shown in FIG. 26 so that the sticks 311 are moved together out of the spread position and into the parallel position, as shown in FIG. 28. When the umbrella is to be put up or opened, the centerpiece 322 is pushed up from the position shown in FIG. 28 so that the sticks 311 will be spread apart. Spreading gear 321 then snaps into the position shown in FIG. 26. Upon spreading of the sticks 311, the ribs are placed in an outstretched or umbrella-open position by actuating the sliders 318.

Figures 30, 31, 32:
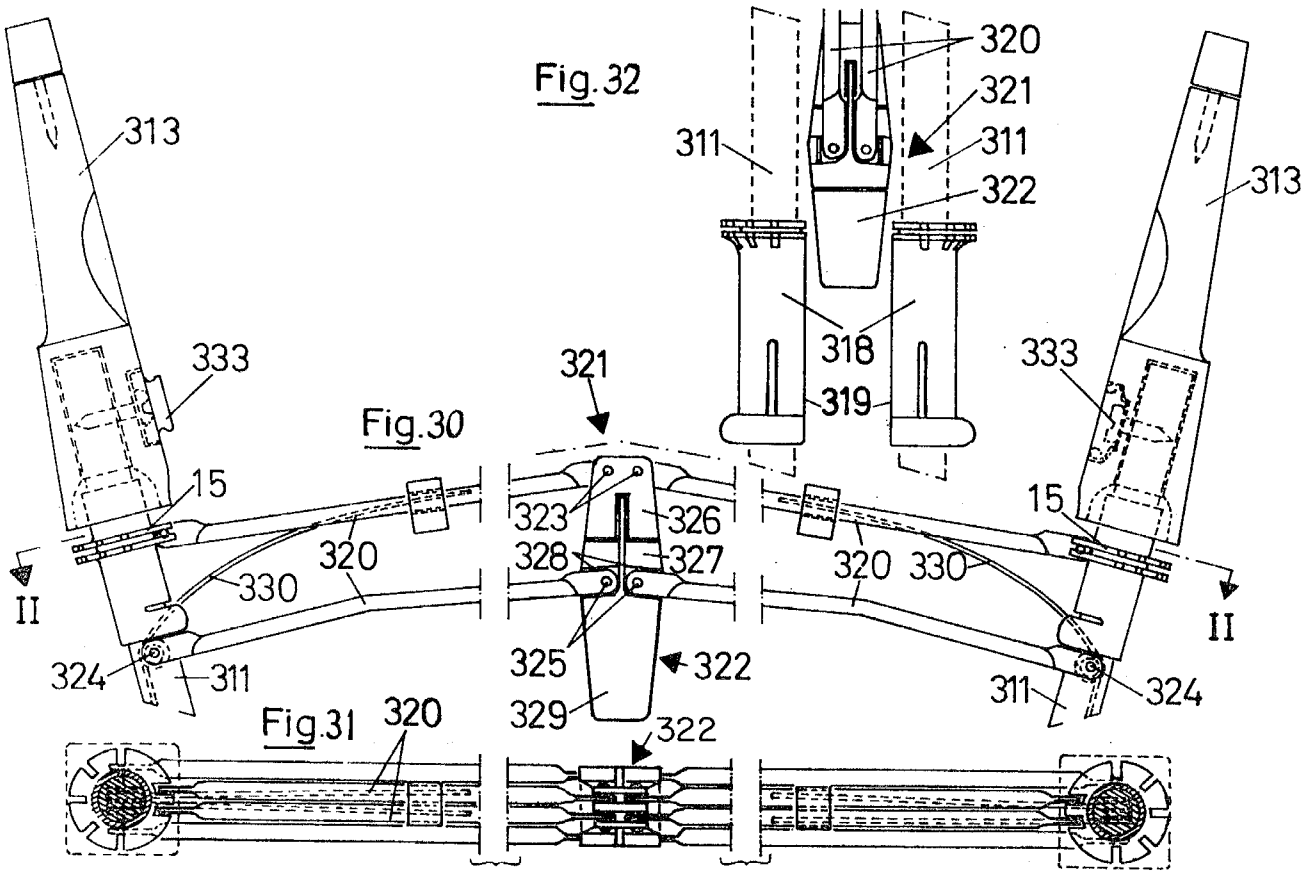
FIG. 30 is a side view of a spreading gear for the sticks of an umbrella according to the present invention.
FIG. 31 is a top view of the spreading gear of FIG. 30 taken along the line II—II thereof.
FIG. 32 is a detailed view of the umbrella sticks and of a spreading gear shown in a folded state.

The spreading gear 321 is shown in greater detail in FIGS. 30–32. The sticks 311 carry at their upper ends stick points 313 which may be formed of wood and which have mounted thereon couplings 333 designed as push buttons on facing sides whereby the sticks 311 may be connected with each other when they are in the parallel position in the manner according to FIG. 28.

At the stick hub 15 arranged in the upper area of the sticks 311 there are provided upper cross rods 320 which are swivelled with one end in the spreading plane. With the other end, the cross rods engage the centerpiece 322 by means of a pin 323.

The lower cross rods 320 run at a specified spacing and generally parallel from each other below the upper cross rods 320 and are supported with one end to sticks 311 by means of pin 324 and with the other end to centerpiece 322 via pin 325.

Centerpiece 322 consists of a central part 326 and a pair of shells 327 arranged on both sides which are equipped on the outside with sunken recesses 328 for receiving the ends of the lower cross rods 320. In accordance with FIG. 30 the shells 327 may be pushed together by a finger pressure overcoming spring forces applied perpendicularly to the plane of the projection so that the ends of the lower cross rods 320 are released by recesses 328 and may be swivelled about pins 325. In order to fold the umbrella pressure is placed upon the part of shells 327 forming the gripper nose 329 and the centerpiece 322 is pulled down in accordance with FIG. 30. In this way the spreading gear 321 will collapse between sticks 311 in a manner shown in FIG. 32. Sliders 318 are flatened on the sides 319 facing each other and on those turned toward spreading gear 321 so that with the closed sticks 311 the sliders may be actuated by by-passing spreading gear 321 as shown in FIG. 32.

In order to open the umbrella, first the sticks 311 are spread by pushing up centerpiece 322 until it snaps in position as shown in FIG. 30. This motion is supported by steel springs 330 which are inserted in sticks 311 in which engage the upper cross rods 320.

In FIGS. 33–35, a simplified spreading gear 351 is shown wherein only two cross rods 350 are provided which extend between sticks 311 and are supported at their midpoints with their ends facing each other by centerpiece 352 by means of a pin 353. At the other ends, cross rods 350 are linked to sticks 311 by means of pins 354.

Cross rods 350 consist of tubular sections having forked ends engaging sticks 311. The bifurcated or forked ends of the cross rods 350 of the spreading gear 351 abut at a point 355, in the position as shown in FIG. 33, upon the circumference of the adjacent stick 311 so that the swivelling motion of cross rod 350 upwardly is limited as shown in FIG. 33. It is to be understood that pin 354 lies outside the alignment given by point 355 in order to insure a safe engaging position.

Furthermore, with the spreading gear 351, the spreading motion is supported by tension springs 360 which are arranged inside of the cross rods 350 forming the tubular sections and which are interconncted by means of tie rod 361 guided by means of a pin 362 attached at the lower end of the centerpiece.

As shown in FIG. 35, a coupling 433 may be provided for sticks 311 which are made of a tubular material. The sticks shown are equipped with longitudinal slots 434 and/or 435 on the sides thereof facing each other. Coupling 433 consists of a W-shaped member of spring material whereby the lower points of the "W" formation form outwardly pointed noses 437. The outer sides 439 of the "W" formation carry outwardly extending handle buttons 438. By pressing the buttons 438, the inner sides 436 of the "W" formation may be pressed together to the extent that the coupling 433 may be engaged within the slot 434. Upon release, the inner sides 436 are spread apart so that the noses 437 pick up the longitudinal set edges of the longitudinal slot 434 and attach the member to stick 311 as shown in FIG. 35 on the left side.

Slot 435 is so dimensioned that upon placing sticks 311 together, the outer sides 439 slide off the longitudinally set edges of longitudinal slot 435 along their slopes 440 and are push together whereby the outwardly pointing hooked noses of the outer sides 439 engage the longitudinal set edges of slot 435 from behind. Compressing the hand operated buttons 439 places the outer sides 439 in close proximity with each other so that coupling 433 may be pulled out of the longitudinal slot 435. The thickness of the sides is so dimensioned that on a normal compression of buttons 438 a decoupling of only the right side is effected as indicated in FIG. 33.

Seated on both of the sticks 311 are spacer pieces 380 located just below the spreading gear 351 in the shape of synthetic material which is pulled over the sticks 311 to enclose them rigidly. On the sides facing each other, the spacer pieces 380 are of a generally U-shaped cross sectional configuration depicted in FIG. 36 whereby the sides of the "U" formation are placed against each other with one side forming a bezel 381 running generally parallel to the stick 311 while the opposing side is equipped with a matching or engaging notch 382 into which the bezel 381 fits. Each side of the spacer piece 380 is applicably equipped with a bezel 381 engaging one of the notches 382 so that the spacer piece 380 fit together in a reverse arrangement as shown in FIG. 36. As a result, one embodiment of the spacer piece 381 may serve a generally universal purpose.

The utilization of spacer pieces 380 will insure that the sticks 311 may be held together in a manner depicted, for example, in FIG. 28, in a secure and generally firm position when the umbrella is utilized in the manner indicated.

In FIGS. 37–44 there is shown an umbrella 400 which constitutes a further embodiment of the invention arranged in a basic assembly which is similar to the umbrella 200 of FIGS. 10–14. In the umbrella 400, no special spreading gear is provided but the spreading of sticks 411 is accomplished by the umbrella ribs 16 themselves with the ribs 16 which face each other between the sticks 411 being interconnected by links 34.

Whereas with umbrella 200 an automatic set-out device is provided which comprises tension springs 221 arranged on sticks 211, such tension springs are eliminated in umbrella 400. Instead, with umbrella 400 the automatic opening or setout device is composed of tension springs which interact between ribs and associated stays 17 of the umbrella. As is particularly illustrated in FIG. 39, spacer pieces 401 having tension springs 421 hooked thereto at their ends are provided on stays 17 and on roof rods 16 at applicable spacings from the link piece 420 at which stays 17 are linked with ribs 16. Tension springs 421 are so arranged that, with referenace to the ribs 16, they are shortened with a swivelling of the stays 17 occurring when the umbrella is opened. The position shown in FIG. 39 in solid line form corresponds to the position of the closed umbrella whereupon on opening of the umbrella the stay 17 assumes a position approximating that indicated in dotted line form. Thus, the tension springs 421 in the embodiment depicted are shortened in length by about half.

Figures 37, 38, 39, 40, 41, 42, 43, 44:
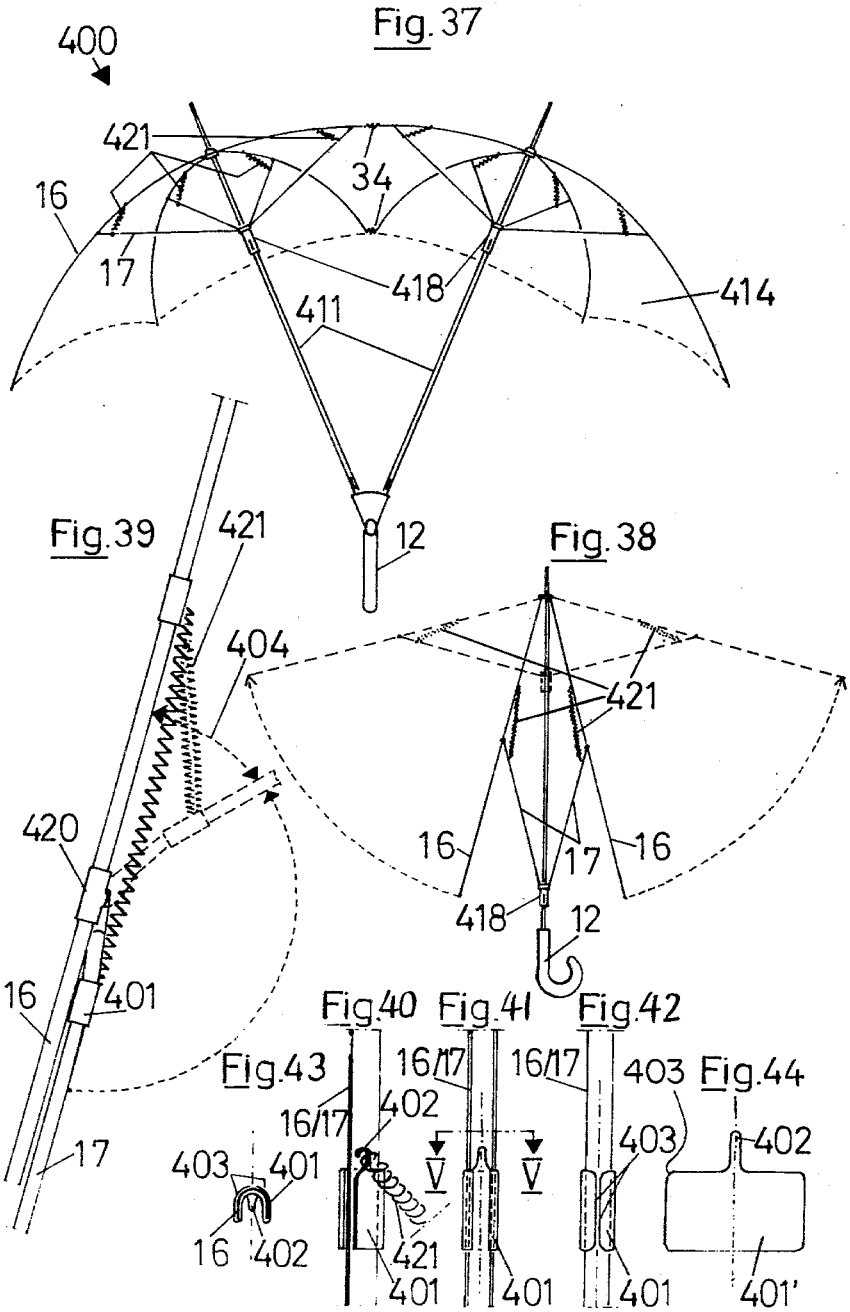
FIG. 37 is a side elevation of a further embodiment of the invention.
FIG. 38 is a schematic illustration depicting the operation of the umbrella of FIG. 37.
FIG. 39 is an enlarged detailed view showing a portion of the spring linkage between stays and ribs of the umbrella of FIG. 37.
FIG. 40 through 44 are detailed views showing a holder piece for attaching a tension spring to the ribs and/or stays of an umbrella according to the present invention.

With the umbrella in the closed position, the tension springs 421 will be stretched when the stays 17 are located in a position to extend generally closer to a position parallel to the umbrella stick. Thus, as a result, the springs 421 will tend to bias the stays 17 and the ribs 16 toward a position whereby a smaller angle therebetween is formed, as indicated in FIG. 39, and as a result, the springs 421 tend to bias the stays 17 and the ribs 16 into the umbrella-opened position. Accordingly, if the umbrella is to be opened, all that is necessary is for sliders 418 to be released whereupon the umbrella 400 automatically moves under spring loading into its opened position in which it may be locked with the sliders 418 in their upper most position as depicted in FIG. 38.

Umbrella 400 is particularly advantageous inasmuch as its assembly is of a rather simple type, with the presence of an automatic opening system being provided.

A structural type of spacer piece 401 is shown in FIGS. 40–44. The spacer piece 401 is of a generally U-shaped profile and may be mounted upon ribs 16. Generally, for stays 17 a similar construction may be of course provided. The material used for the spacer piece 401 may be sheet metal and a sheet metal blank of an appropriate shape is shown in FIG. 44 with the blank being bent around into the U profile in the manner depicted in FIG. 43 so that a tongue 402 will be formed to lie inside U-profile with lateral edges 403 overlapping a ridge of the "U" from the outside. Tension spring 421 is developed as a helical spring and covers the tongue 402, as indicated in FIG. 40 with a lug provided at its end. Spacer or holder piece 401 is then seated in a skid proof arrangement in a longitudinal direction on a rib 16 whereby a connection with a tension spring 421 is moved to the inside of the U-profile.

Figure 45:
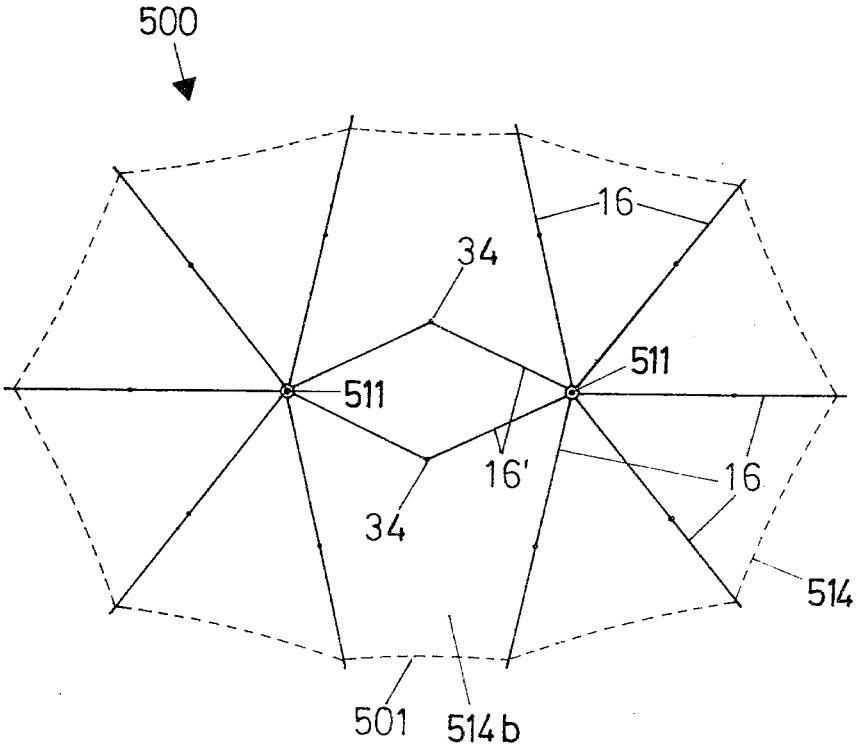
FIG. 45 is a top view of an umbrella comprising a further embodiment of the invention.

In FIG. 45 an umbrella 500 of a particularly simple design is shown. In this umbrella, each stick carries seven ribs 16, 16' of which in each case both inner ribs 16', placed next to each other between sticks 511, are interconnected by links 34 (see FIGS. 15"21). The other ribs 16' are of equal length and all the ribs 16, 16' are circumferentially arranged at identical spacings. The outwardly pointed ribs 16 facing the ribs 16' lie in the plane of sticks 511 so that the lateral projection of the umbrella 500 is substantial.

Similar to umbrella 300 of FIG. 37, the ribs 16 adjacent the ribs 16' are not interconnected at their ends. However, umbrella 300 is equipped with a spreading gear 321 and may be selectively used either with the enlarged or standard peripheral outline of the umbrella canopy whereas umbrella 500 is provided only for a covering according to FIG. 45.

The missing interconnection of ribs 16 with adjacent ribs 16 at their ends results in the formation a center wedge-shaped portion **514*b* of the canopy 514 having no fixed cutting design so that the umbrella canopy in an opened or upward position may be designed more or less with a bulging configuration by modifying the length of the outer sides 501**.

Especially, in connection with the springs 421, the loaded automatic opening device of FIGS. 39–44, designed according to FIG. 45, produces a generally simplified light weight and still automatically actuated umbrella.

While specific embodiments of the invention have been shown and described in detail to illustrate the application of the inventive principles, it will be understood that the invention may be embodied otherwise without departing from such principles.

What is claimed is:

1. An umbrella for the protection of persons against weather conditions comprising handle means enabling said umbrella to be gripped by a user, stick means attached at one end thereof to said handle means, a plurality of ribs pivotally mounted with said stick means, a canopy attached upon said ribs, slider means on said stick means slideably movable to open and close said canopy of said umbrella, a plurality of stays each pivotally mounted at opposite ends thereof, respectively to said ribs and to said slider means, said ribs extending from said stick means radially therefrom and being circumferentially distributed thereabout, with movement of said slider means on said stick means operating through said stays to cause pivotal motion of said ribs about said mounting on said stick means to open and close said canopy by stretching said canopy when said ribs are extended radially outwardly from said stick means, said canopy being brought to a folded condition about said stick means when said slider means is moved to bring said ribs in a generally parallel condition relative to said stick means, said umbrella further comprising tension springs which are engaged between each of said ribs and said stays, said spring means operating to spring load the angle between said stays and said ribs toward the open condition of said umbrella, with release of said slider operating to effect changes in the angle between said stays and said ribs as a result of the biasing force of said spring means to move said slider along said stick means toward the open position of said umbrella.

2. An umbrella according to claim 1 further comprising holder pieces provided on said ribs and on said stays said holder pieces operating to connect said ends of said springs to said ribs and said stays.

3. An umbrella according to claim 2 wherein said holder pieces are formed of sheet metal parts enclosing said ribs and said stays.

4. An umbrella according to claim 1 wherein said tension springs are formed as helical springs.

5. An umbrella according to claim 4 wherein said holder pieces are equipped with tongues which may be hooked at the ends of said helical springs with stay eyelets.

6. An umbrella according to claim 1 wherein said umbrella comprises two sticks, each of said sticks being provided with seven ribs circumferentially arranged in a uniform spacing to extend radially about each of said sticks, five of said ribs being of equal length and the remaining of said ribs being shortened, said shortened ribs extending between said sticks and extending toward each other with the ends of said shortened ribs being interconnected by links.

* * * * *